United States Patent [19]

Olsen et al.

[11] Patent Number: 4,674,919

[45] Date of Patent: Jun. 23, 1987

[54] OFF-SHORE PLATFORM STRUCTURE

[75] Inventors: Olav Olsen; Jon Hermstad, both of Oslo, Norway

[73] Assignee: Norwegian Contractors, Stabekk, Norway

[21] Appl. No.: 771,728

[22] Filed: Sep. 3, 1985

[30] Foreign Application Priority Data

Sep. 4, 1984 [NO] Norway ..... 843519

[51] Int. Cl.[4] ..... E02B 17/00

[52] U.S. Cl. ..... 405/226; 405/207; 405/224

[58] Field of Search ..... 405/203, 205, 207, 208, 405/224, 226

[56] References Cited

U.S. PATENT DOCUMENTS 1,971,046 8/1934 Moran ..... 405/226 X
2,021,014 11/1935 Moran ..... 405/226 X
3,925,997 12/1975 Hafskjold ..... 405/224 X
3,928,982 12/1975 Lacroix ..... 405/224
4,087,984 5/1978 Mo ..... 405/224 X
4,304,506 12/1981 Olsen ..... 405/224

*Primary Examiner*—David H. Corbin
*Attorney, Agent, or Firm*—Fleit, Jacobson, Cohn & Price

[57] ABSTRACT

Method for founding and stabilizing an off-shore platform which at its lower end is provided with skirts. The skirt or skirts are forced so deep down in the ground that a significant portion of the foundation area is transferred down to a depth where the load carrying strength of the ground is sufficient in regards to geotechnical stability and that it prevents an acceptable settlement.

The platform (1) which is intended to be installed at very great depths, includes a foundation structure to be forced down in the sea bed, a cell portion that in its operational position is completely submerged, and an upper portion extending from the cell portion and up above the sea surface, where the submerged cell portion includes a centrally located cell surrounded by at least one cell portion.

8 Claims, 17 Drawing Figures

OFF-SHORE PLATFORM STRUCTURE

The present invention relates to an off-shore structure suitable for drilling for and production of hydrocarbons. The off-shore structure is intended to be installed at very great depths, preferably more than 200 meters. Particularly, but nor exclusively, the present invention relates to a platform that is well suited to be built in concrete. The off-shore structure comprises a foundation or base structure, intended to be forced down in the seabed, a cellular lower structure or substructure that is completely submerged in its operational position, and an upper structure extending from the said lower structure upwards above the surface, which may support a deck superstructure above the surface. The lower structure comprises a centrally located cell surrounded by at least one ring of cells. The upper structure may be formed by extending the walls of at least one of the cells in the lower structure.

The present invention also relates to a method for constructing the foundation of an off-shore structure which at its lower end is provided with a foundation structure in the form of downward extending skirts that are open at their lower end and closed at their upper end, intended to be forced down into the seabed for support of the off-shore structure.

Previous opinion has been that gravitation platforms of the caisson type, for example the well known Condeep platform, is unsuitable for use at depths in excess of 200–250 meters. At such depths it has so far only been suggested the use of floating production platforms and/or truss type platforms or the platform type as disclosed in Norwegian Pat. Nos. 140,431 and 142,005. One of the reasons that the caisson type platforms so far have been considered unsuitable for great depths is that the forces and dynamic motions caused by wave motion have been considered too great for the practical application of such platforms at great depths. Also, this effect would be amplified in cases where the platform is provided with more than one column, as the effect increased rapidly with an increase number of columns. Furthermore, the great water pressure exerted on the lower portion of the platform structure will result in the need for extremely large wall thickness in the air filled portions of the platform, with consequent increase in weight and cost.

An object of the present invention is to provide an off-shore platform structure that will overcome the above disadvantages, that is suitable for installation at depths in excess of 200–250 meters and that can be built in a relatively short time, say 3–4 years. A further object is to provide a platform structure that is substantially based on well tried building techniques where dimensions to a great extend have been optimized.

A further object of the present invention is to provide a foundation that works like a pile foundation, but where the foundation itself can be constructed without the time consuming pile driving operation; where a significant portion of the vertical forces from the platform and/or waves will be carried by friction/adhesion along the skirt walls, plus point loading so that significant portions of the vertical load are displaced to deeper ground layers where load carrying strength is sufficient without a pile structure.

Still another object of the invention is to provide a founding method and a foundation where the need for grouting of the space bounded by the skirt walls, the sea bed and the lower structure is fully or partially eliminated.

According to the invention there is provided a platform in which the lower structure is equipped with cells where the inside diameters of the cell walls are tangent to one another.

According to a preferred embodiment, the upper structure consists of at least one column that is formed by extending the walls of the lower structure, while the cell shape is altered from a part polygonal, part circular, to an all circular cross section.

Further, the walls of the lower structure may have decreasing wall thickness in the upward direction. In addition portions of the cell walls, for example walls of individual cells of the lower structure, may be dimensioned not to withstand significant water pressure.

The present invention further provides a structure where water under pressure is pumped into the space between the sea bed, the skirt walls and the lower structure after the off-shore structure is planted on the sea bed and the skirts have penetrated the sea bed to desired depths. The high pressure is maintained either by sealing the said space and/or by a more or less continuous maintenance of pressure by other means, for example by pumping.

By carrying the vertical forces caused by the weight of the platform and the waves by friction/adhesion along the skirt walls at the significant height, and by the loading points at the end plates of the skirts, the platform will work more like a pile structure than a gravitation platform. The vertical load may be adjusted by varying the water ballast in the platform. Possible setting may be compensated for by pumping water into the space formed by the skirt walls, the sea bottom and the lower structure, and/or by reducing the water ballast in the platform.

To increase the load bearing surface of the platform in the horizontal and/or vertical direction, it is possible to provide additional rings of cells along the lower portion of the lower structure. Advantageously the walls of the additional cells may be dimensioned not to withstand a significant external water pressure.

The skirts according to the present invention may for example have a height in excess of 30 meters, while the lower structure may have a height in excess of 150 meters. Height and weight of the lower structure, including the skirt heights, may be adjusted to the towing depths rather than to the effect of wave load at the platform location.

According to another preferred embodiment, lower portions of the lower structure may consist of walls that are not designed to withstand higher water pressure, while the upper portion of the lower structure is made as a high pressure unit where the high pressure portion functions as an intermediate bracing structure for the column cells.

The platform according to the present invention may have one, two or more columns. The columns may be formed by one or more cells in the first ring of cells around the central cell. This makes possible a more flexable deck lay out.

For a more detailed description of the preferred embodiments of the present invention reference is made to the drawing figures, wherein.

Figure 1:
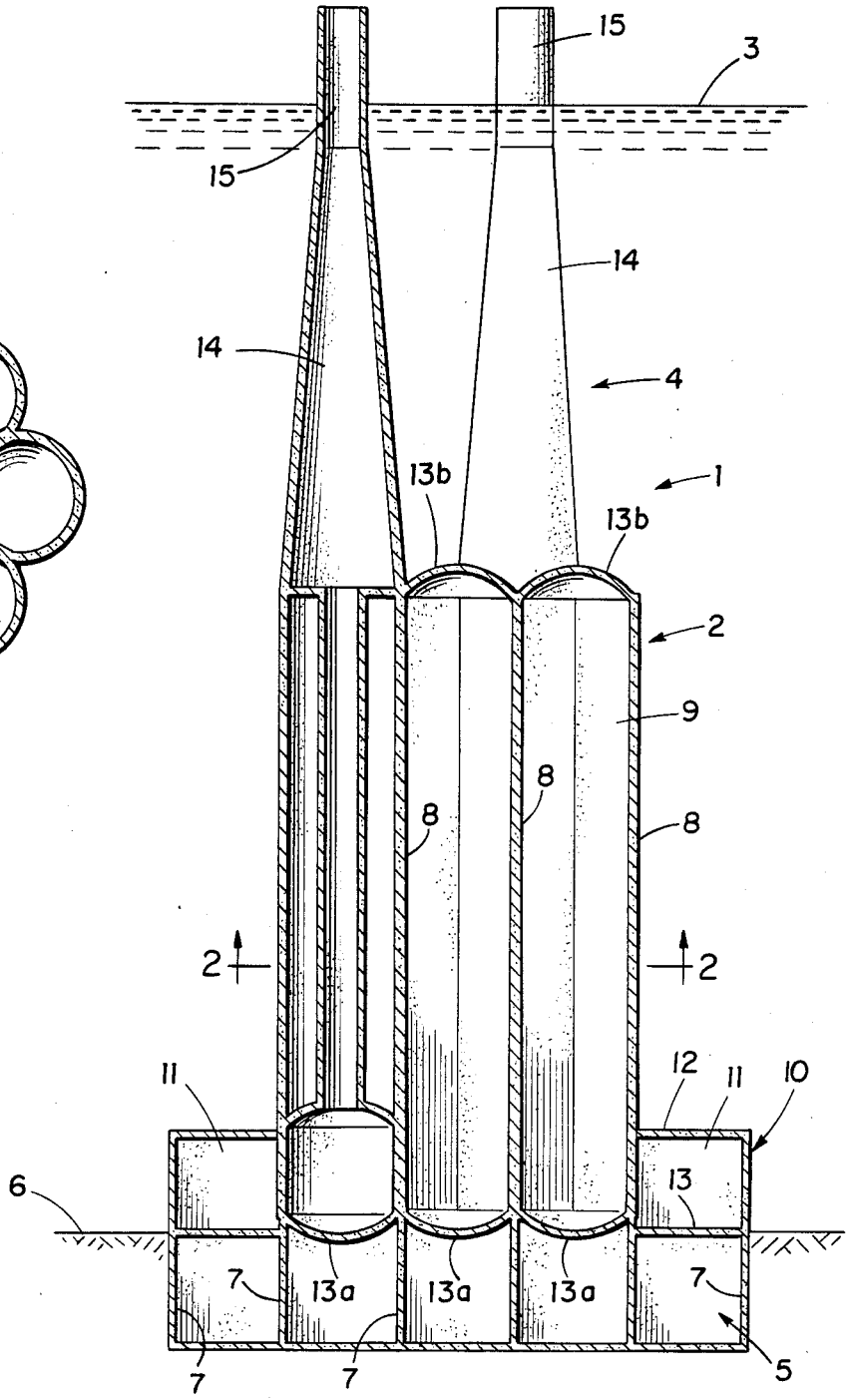
FIG. 1 shows a vertical section through an offshore structure intended for installation at a depth of 334 meters.

FIG. 1 shows a vertical section through a preferred embodiment of an off-shore platform structure 1 according to the present invention. The platform structure 1 comprises a completely submerged lower section 2, from which extends an upper construction 4 up to above the sea surface 3, plus a foundation or base structure 5 which is forced down in the sea bed 6. The platform shown in FIG. 1 is intended to operate at very great depths, and may for this purpose be equipped with a deck superstructure (not shown) plus equipment for drilling for and/or production of hydrocarbons.

The foundation structure 5 includes a plurality of skirts 7. These may for example consist of cylindrical, vertical tubes or of vertical walls which to a greater or to a less degree are connected with one another. The skirts may for example be made of concrete, and unlike the previously used skirts, may have a considerable thickness, for example 45–70 cm. The said skirt 7 is given a sufficient vertical dimension to be forced down in the sea bed, for example by ballasting the platform during the installation phase, that the lower layers in the sea bed help in carrying the platform. The skirts 7 in the present case consist of an extension of the walls 8 in the cells 9 in the lower section 2. However, the thickness of the walls in the skirts 7 is less than the thickness of the walls 8 in the cells 9. As shown in FIG. 1, the lower structure 2 is in addition equipped with an outer ring of cells 10. This comprises a plurality of cells 11 which are connected with one another in the same manner as the inner ring of cells. In addition the outer ring of cells 10 is connected with the inner ring of cells by means of upper and lower plates (12, 13) plus vertical discs (not shown) extending across the cells 11 in the outer ring of the cells 10, radially inwards to the outer walls of the cells 8 where these end. The outer ring of cells 10 have a small height, and are not dimensioned to withstand a pressure beyond that which will arise during towing from the dock and the first stage of casting of the lower section.

Cells 9 in the lower section 2 are at their lower end provided with a lower spherical shell 13*a*. The cells 9 in the lower section which is completely submerged are equipped with corresponding upper spherical shells 13*b*.

The upper structure 4 comprises columns 14 which are formed by extending the walls 8 in some of the cells 9 in the lower portion up above the sea surface 3. The columns 14 consist of a lower, tapered portion and an upper, cylindrical portion 15. In the example shown in FIGS. 1 and 2 the platform is equipped with three columns, located symmetrically around the platform's central axis.

Figure 2:
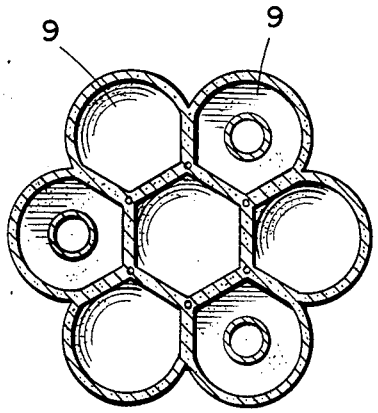
FIG. 2 shows an horizontal section viewed along the line 2—2 in FIG. 1.

As shown in FIGS. 1 and 2, the cell walls 8 in the lower structure are very thick, that is in the order of 1,5–3 meters. This means that the walls in an area with adjacent cells will have about a double wall thickness.

Further, the cells 9 in the lower structure are constructed in such a way that the inside walls, rather than the outside walls, are tangent to one another. Accordingly, with wall thickness as in the present case, the cells 9 along the contact surfaces with adjacent cells will take a hexagonal shape in cross section, while the contact surface with the outside water will be shaped as a single curved surface. The thickness of the walls 8 in the cells 9 decrease toward the upper end.

Figure 3:
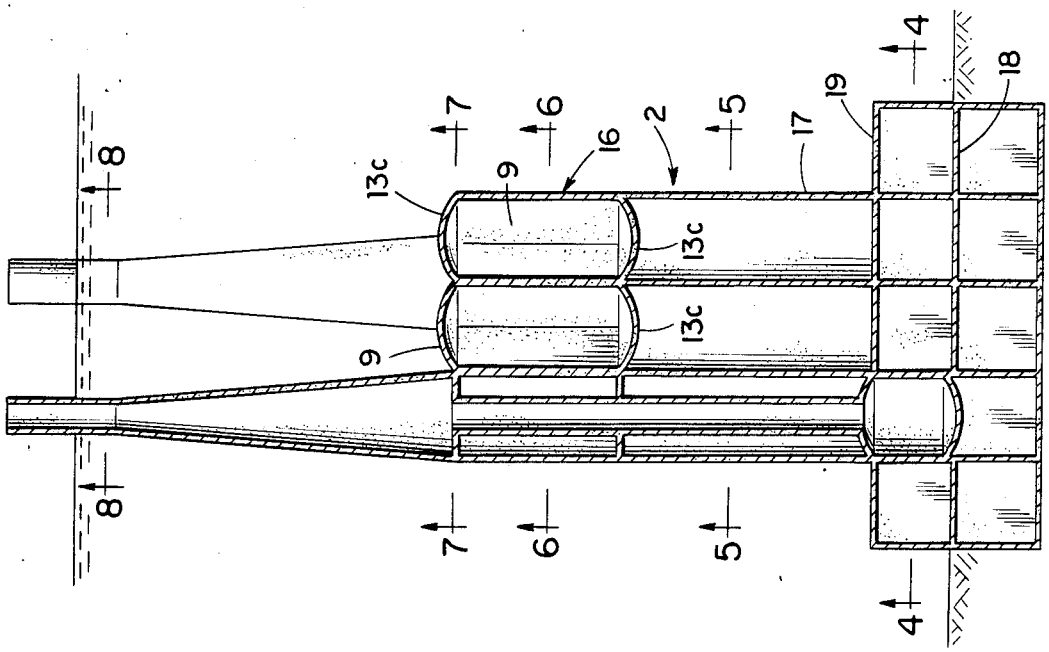
FIG. 3 is a view like FIG. 1 showing another embodiment of the invention.
Figure 12:
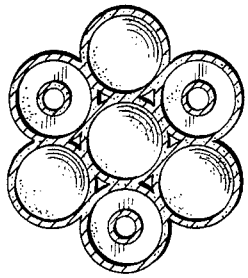
FIG. 12 is a horizontal section of FIG. 9 taken along line 12—12.
Figure 11:
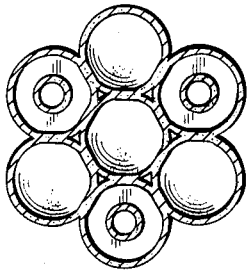
FIG. 11 is a horizontal section of FIG. 9 taken along line 11—11.
Figure 14:
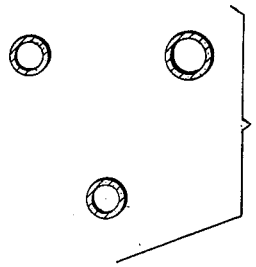
FIG. 14 is a horizontal section of FIG. 9 taken along line 14—14.
Figure 13:
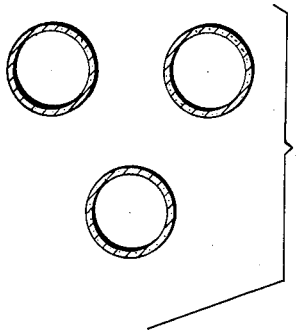
FIG. 13 is a horizontal section of FIG. 9 taken along line 13—13.

FIG. 3 shows another embodiment according to the present invention. The following discussion will describe only differences from the example shown in FIG. 1.

Figure 4:
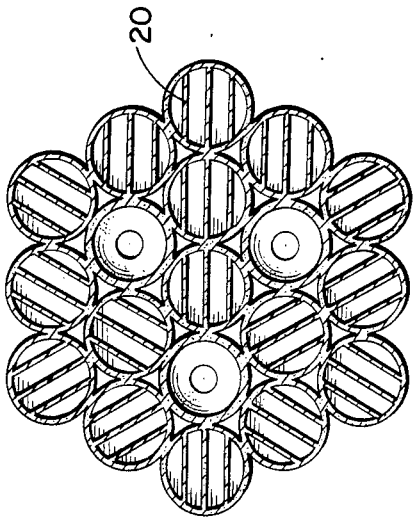
FIG. 4 is a horizontal section of FIG. 3 taken along 4—4.

One significant difference is that only the upper portion 16 of the lower structure 2 is defined to stand high pressure, while the lower portion 17 is not dimensioned to withstand significant water pressure. For this purpose the cells in the upper portion 16 of the lower section 2 are equipped with upper and lower spherical shells 13*c* located in the upper portion 16. In addition the walls in this portion have thickness and reinforcement corresponding to parts of the cell walls in the example shown in FIG. 1. According to this arrangement the upper portion 16 is intended to be partially or fully filled with air, as are the column or columns. The lower portion 17 of the lower structure 2, however, is intended to be filled with water and to be in communication with the surrounding water. Another significant difference consists of a horizontal, substantially plane base plate 18 plus an upper plate 19 which extends through the entire lower structure 2 except the three column cells. In addition, the cell portion between the two horizontal plates 18, 19 is equipped with vertical walls 20 corresponding to the outer, low ring of cells as described in connection with the example shown in FIG. 1. These are also, with the exception of the three column cells, provided in all the cells 9 in the lower construction, as shown in FIG. 4.

Figure 5:
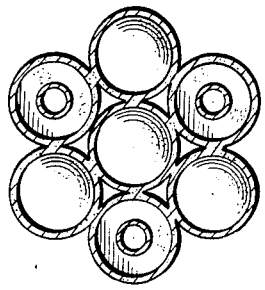
FIG. 5 is a horizontal section of FIG. 3 taken along line 5—5.
Figure 6:
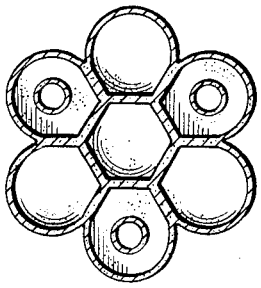
FIG. 6 is a horizontal section of FIG. 3 taken along line 6—6.
Figure 8:
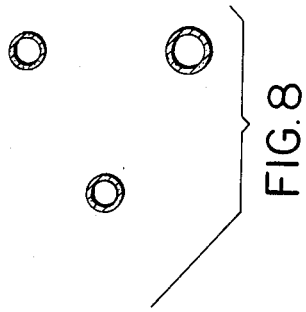
FIG. 8 is a horizontal section of FIG. 3 taken along line 8—8.
Figure 7:
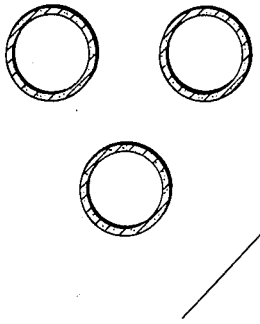
FIG. 7 is a horizontal section of FIG. 3 taken along line 7—7.

FIG. 5 shows a horizontal section viewed along the line 5—5 in FIG. 3, while FIG. 6 shows the corresponding horizontal section through the upper high pressure portion 16 in the lower structure, viewed along the line 6—6 in FIG. 3.

A final difference is that the diameter of the cylindrical portion of the columns, and consequently the conical taper, is different.

Figure 10:
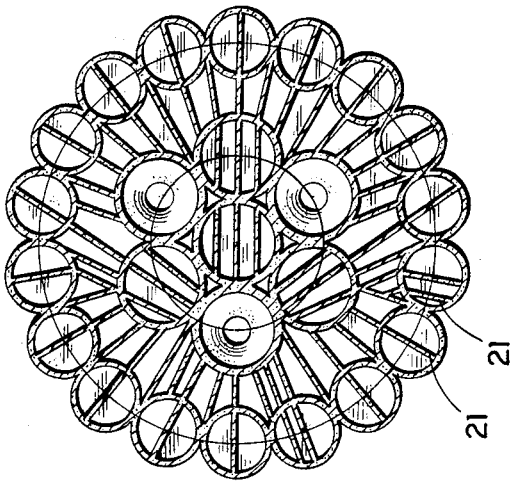
FIG. 10 is a horizontal section of FIG. 9 taken along line 10—10.
Figure 9:
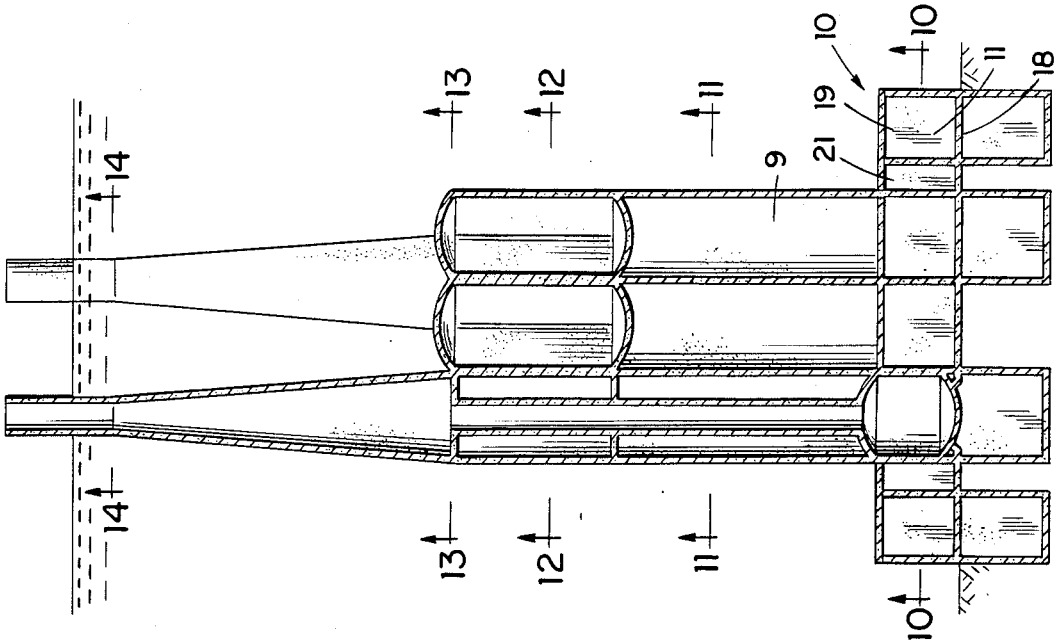
FIG. 9 is a view like FIGS. 1 and 3 showing a third embodiment of the invention.
Figure 16:
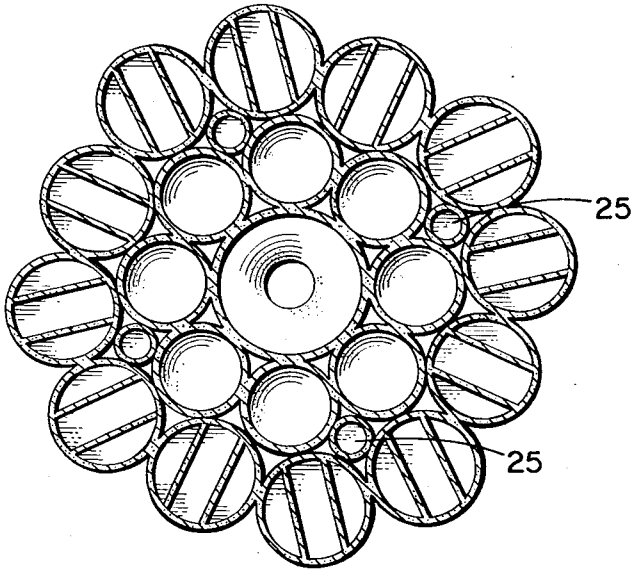
FIG. 16 is a horizontal section of FIG. 15 taken along line 16—16.

FIGS. 9–14 show a third embodiment of the present invention, where the only significant difference as compared to the example of FIGS. 4–8 lies in the arrangement of the ring of cells 10 around the lower portion of the lower structure 2. According to this example the lower portion is formed by a ring of cells 11 which is spaced from the cells 9 in the lower structure 2. The said ring of cells is, however, rigidly connected with the cells 9 by means of the upper and lower plates 19, 18 and the walls 21 which extend diametrically through the cells of the lower ring of cells 11. The configuration of the disc walls is shown in FIG. 10.

Figure 15:
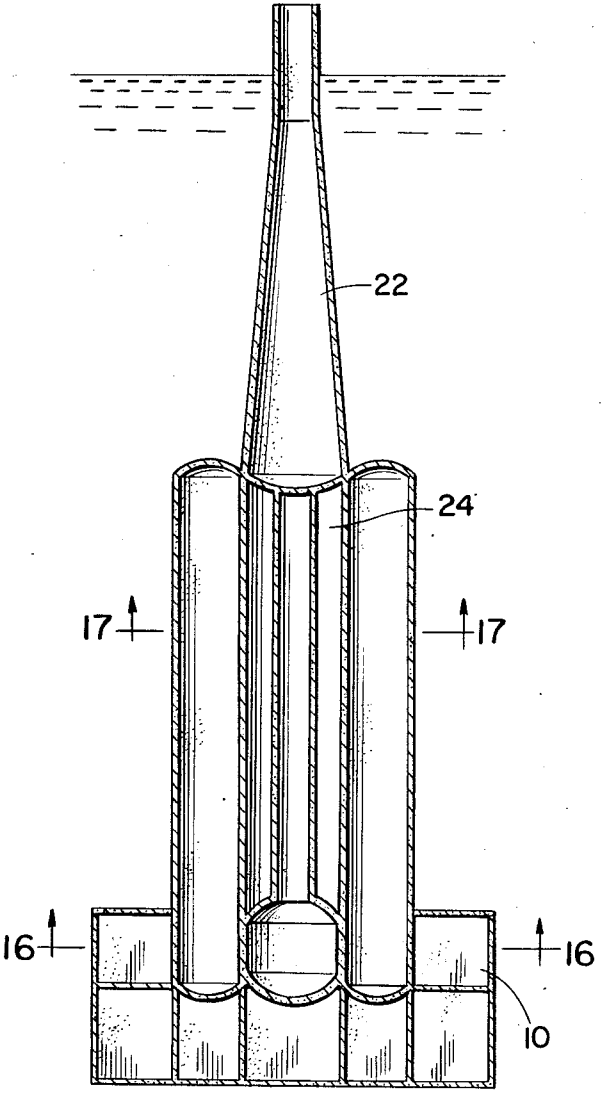
FIG. 15 is a view like FIGS. 1, 3 and 9 showing a fourth embodiment of the invention.

FIG. 15 shows a fourth embodiment of the present invention, equipped with only one central column 22. According to this embodiment the diameter of the cells 23 in the ring of cells around the central cell 24 is different from the diameter of the central cell 24.

Figure 17:
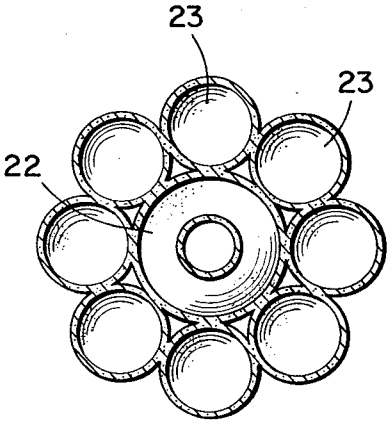
FIG. 17 is a horizontal section of FIG. 15 taken along line 17—17.

If a construction with four columns is desired, it is possible to use the cell configuration shown in FIG. 17, where the walls of the cells marked with x may be extended upward to form columns instead of the central cell.

To fit the lower ring of cells 10 four additional small cells 25 are provided.

Common to the embodiments shown is that they are all made of concrete and are suitable for the principle of sliding forms. The method will generally be like the building of the Condeep platforms, i.e. the skirts and the lower portion of the lower structure are built in a dry dock, whereupon the platform is launched and towed to the deep water site where the remaining portion is completed. A significant difference, however, is that the skirts are also cast by means of the principle of sliding forms.

A further common feature is that the platforms are towed out to the drilling site with the top of the lower structure extending up above the sea surface.

Although the embodiment examples are shown with the lower structure consisting of a central upright cell plus a surrounding ring of cells with corresponding height and radius, it will be noted that additional rings of cells may be provided outside the shown ring of cells. Further, the diameter of the cells may differ from the diameter of the central upright cell. If the diameter of the central cell is greater than that of the surrounding cells, the number of cells in the surrounding ring must necessarily be greater than what is shown on the figures and vice versa.

It shall be further noted that the invention is not limited to the shown arrangement with one or three columns, but may have any suitable number of columns depending on the desired deck structure.

We claim:

1. Method for founding and stabilizing an off-shore platform, said method comprising: providing an off-shore platform which at its lower end is equipped with skirts intended to be forced down in the sea bed, and which at least provides parts of the platform's foundation, the skirts being open at their lower end and closed at their upper end by an upper closure, forcing the skirts so far down in the sea bed that significat portions of the foundation area are displaced down to a depth where the bearing capacity of the ground is sufficient with regard to geotechnical stability to prevent unacceptable settlement, after the platform is put down on the sea bed and the said skirt has penetrated the sea bed to a desired depth, pumping water under pressure into the space between the sea bed, the skirt wall and the upper closure, and maintaining water pressure in the space during the working life of the platform.

2. Method as stated in claim 1, wherein said water is under a high pressure that does not exceed a pressure that the sea bottom enclosed in the skirt can withstand without causing any flow of water through the said sea bottom.

3. Method as stated in claim 1, including the steps of pumping an additional volume of water into the space to compensate for settlement of the skirts in the sea bottom, so that the platform remains at the same level with respect to the sea surface.

4. An offshore platform structure intended to be installed at large depths, comprising: a support structure intended to be pressed down into the sea bed soil, a complete submerged caisson extending upwardly from the support structure and including a plurality of cells, and a deck supporting structure extending upwardly from the caisson and up above the sea bed, for supporting a deck superstructure above the sea surface, said deck supporting structure including at least one column filled with air at atmospheric pressure, said at least one column formed by extending the walls of at least one cell in the caisson, the caisson including a centrally arranged cell and at least one ring with continguous cells surrounding said centrally arranged cell, wherein the at least one air filled column is positioned at the periphery of the caisson, at least one of the remaining cells of the caisson filled with air and positioned on the opposite side of the vertical axis of symmetry of the caisson and positioned at an upper part of the completely submerged caisson.

5. Off-shore structure as stated in claim 4, wherein inside walls of the cells are tangent to one another.

6. Off-shore structure as stated in claim 5, wherein the cross sectional shape of the cells is partly hexagonal and partly circular and the cross sectional shape of the at least one column is a fully circular shape.

7. Off-shore structure as stated in claim 4, wherein walls of the completely submerged caisson having decreasing wall thickness in the upward direction.

8. Off-shore structure as stated in claim 4, wherein at least parts of walls in the caisson are not dimensioned to withstand significant pressure differences.

* * * * *